US006085903A

United States Patent [19]

Jotcham et al.

[11] Patent Number: 6,085,903

[45] **Date of Patent: *Jul. 11, 2000**

[54] SECURITY PACKAGING

[75] Inventors: Richard Bryan Jotcham, Trowbridge; David Edwards, Stevenage, both of United Kingdom

[73] Assignee: Portals (Bathford) Limited, London, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/794,275

[22] Filed: Jan. 31, 1997

[30] Foreign Application Priority Data

Jan. 31, 1996 [GB] United Kingdom ..... 9601984

[51] Int. Cl.[7] ..... B65D 85/00

[52] U.S. Cl. ..... 206/459.5; 206/807; 283/83; 283/91

[58] Field of Search ..... 206/459.5, 807; 283/83, 81, 91

[56] References Cited

U.S. PATENT DOCUMENTS

| | | | |
|---|---|---|---|
| 1,303,934 | 5/1919 | Mace | 206/459.5 |
| 2,362,181 | 11/1944 | Zimmerman | 206/459.5 |
| 2,845,728 | 8/1958 | Huber | 206/807 |
| 3,854,581 | 12/1974 | Jones, Jr. | 206/807 |
| 4,165,002 | 8/1979 | Meagher | 206/459 |
| 4,479,588 | 10/1984 | Davis et al. | 206/807 |
| 4,746,052 | 5/1988 | Schmissrauter | 229/102 |
| 4,746,061 | 5/1988 | Arvanigian | 229/102 |
| 4,972,953 | 11/1990 | Friedman et al. | 206/807 |
| 4,998,666 | 3/1991 | Ewan | 206/807 |
| 5,064,664 | 11/1991 | Hustad | 206/807 |
| 5,148,970 | 9/1992 | Johnston | 206/807 |
| 5,312,680 | 5/1994 | Simpson | 206/807 |
| 5,524,758 | 6/1996 | Lupul | 206/459.5 |
| 5,762,263 | 6/1998 | Chamberlain, IV | 283/83 |

FOREIGN PATENT DOCUMENTS

| | | |
|---|---|---|
| 0257835 | 7/1987 | European Pat. Off. . |
| 195 11 962 A1 | 1/1996 | Germany . |
| 2100860 | 1/1983 | United Kingdom . |
| 2233278 | 1/1991 | United Kingdom . |
| 2242396 | 10/1991 | United Kingdom . |
| 2243578 | 11/1991 | United Kingdom . |
| 2278767 | 12/1994 | United Kingdom . |
| 2289040 | 11/1995 | United Kingdom . |
| 8400345 | 2/1984 | WIPO . |

*Primary Examiner*—Timothy Speer
*Assistant Examiner*—Cathy F. Lam
*Attorney, Agent, or Firm*—Watson Cole Grindle Watson, P.L.L.C.

[57] ABSTRACT

A security packaging incorporates security features as an integral part thereof. A blank made from a substantially rigid material incorporates at least one repeatedly verifiable authenticating security feature which cannot be separated from the material without causing damage to it. The security feature may comprise a multilayer laminate.

40 Claims, 2 Drawing Sheets

SECURITY PACKAGING

The invention relates to security packaging and the manufacture thereof, in particular to the incorporation of security features into packaging so as to form an integral part thereof.

A number of industries, especially those involved in luxury products such as perfume, experience major counterfeiting and theft problems which result in the loss of millions of pounds each year. The packaging used for such items is a particular target for counterfeiters. In many cases if the external packaging looks genuine, a customer will not check the product within the packaging and counterfeit products are very commonly sold this way. Also where a consignment of a genuine product which has been stolen in one area can be transferred for sale to another area of the world and put on the market. Often the original proprietors have no means of tracing where it originally came from, and thus the ability to trace the theft is very much reduced. In the luxury goods market especially, not only is there a financial loss from such counterfeiting and theft, but also the prestige of the original goods manufacturer and their products is also affected.

Various tamper evident features have been proposed for packaging, but none of these provide any guarantee of authenticity.

Most products sold on the market now include on their packaging a bar code which can be machine-read and provides information about what the product is. These bar codes do not address the problem of counterfeit products as the bar codes themselves can be counterfeited. Another problem with such bar codes is that they are often applied to the packaging by means of labels which can be removed using solvents. Similar problems have been experienced with holograms and other security features applied to the surface of the packaging.

It is therefore an object of the present invention to provide security packaging, and a blank therefor, which incorporates one or more security features which cannot be removed without the packaging being destroyed or on the tampering being evident. It is also a further object of the present invention to provide such security packaging, and a blank therefor, which can be mass produced, but each individual unit has a unique identifying feature incorporated therein.

According to the invention there is provided a blank for a counterfeit resistant security package made from a substantially rigid material incorporating at least one authenticating security feature which is repeatedly verifiable without causing damage to the material, or causing damage or a permanent change to the security feature itself, in which said at least one security feature forms an integral part of the material of the blank, such that it cannot be separated from the material without the destruction of the material and/or the at least one security feature.

Preferably the at least one security feature is visible to the eye and/or detectable by touch and/or machine-readable.

The at least one security feature may become visible when subjected to a change in temperature and/or when subjected to infrared or fluorescent light.

Preferably the at least one security feature is encoded and it is preferably encodable.

The material of the blank preferably comprises a plurality of substrates laminated together to form an integral sheet.

One of the substrates preferably comprises security paper incorporating the at least one security feature and one of the substrates preferably comprises a backing layer of folding box board.

In a preferred embodiment of the invention the substrates are laminated together by means of an adhesive.

The at least one security feature may be incorporated in the adhesive.

The adhesive is preferably coloured.

At least one of the substrates may be coloured.

The backing layer substrate is preferably of a darker colour than the security paper substrate.

Preferably the material of the blank is formed from a single substrate incorporating the at least one security feature.

The at least one security feature preferably provides a unique identifier.

Preferably the unique identifier is randomly generated.

Preferably the unique identifier is generated before the security feature is incorporated into the blank material.

The at least one security feature may be provided with the unique identifier after its incorporation into the blank material.

In a preferred embodiment of the invention the security package comprises a plurality of security features some or all of which may be the same or different.

Preferably the at least one security feature is continuous or repeated from a first edge to an opposing edge of the blank.

The invention also provides a security package comprising a container made from a blank as described above.

The invention further provides a method of making a counterfeit resistant security package comprising the steps of forming a sheet of substantially rigid material incorporating at least one authenticating security feature which is repeatedly verifiable without causing damage to the material, or causing damage or a permanent change to the security feature itself, said at least one security feature forming an integral part of the material of the blank, such that it cannot be separated from the material without the destruction of the material or the at least one security feature, cutting at least one blank from the sheet of material and assembling a security package from said blank, wherein normal opening of the security package does not damage or cause a permanent change to the security feature.

The method preferably further comprises the step of laminating a plurality of substrates together to form an integral sheet of said material.

Preferably the method further comprises the step of making security paper containing the at least one security feature to form a first substrate.

The method preferably further comprises the step of making folding box board to form a second substrate.

The method may also comprise the step of making continuous webs of the first and second substrates and continuously laminating the substrates together.

The substrates are preferably laminated together by means of an adhesive.

The at least one security feature is preferably incorporated in the adhesive before the laminating step.

A dye or other colorant may be added to the adhesive before the laminating step.

The at least one security feature may be continuous or repeated from a first edge to an opposing edge of the blank.

The at least one security feature is preferably encoded with a unique identifier before its incorporation into the material.

Alternatively the security feature in encoded with a unique identifier after its incorporation into the material.

The unique identifier is preferably randomly generated.

Preferably the unique identifier is generated by applying a plurality of offset strings of indicia to a web of security film, slitting the web to form a plurality of security threads out of register with the strings of indicia and incorporating one or more of said security threads into the material, such that the thread is exposed at intervals in windows in a surface of the material.

The strings of indicia may be applied to a discrete or series of discrete security features.

A preferred embodiment of the present invention will now be described in detail, by way of example only, with reference to the accompanying drawings in which.

Figure 1:
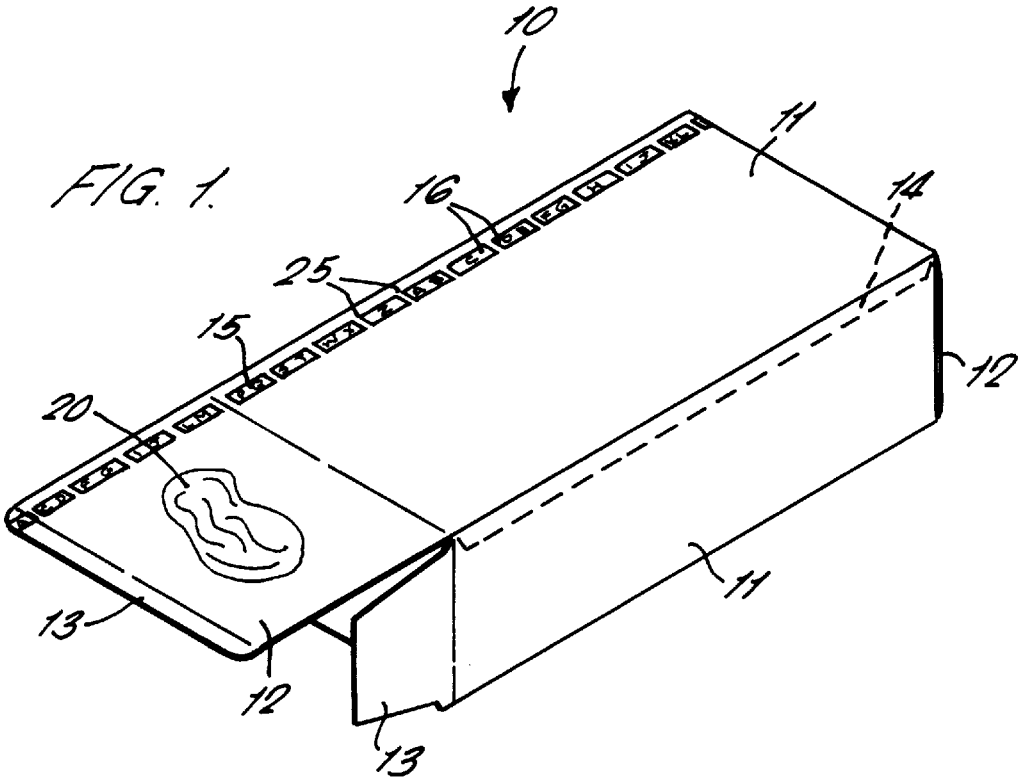
FIG. 1 is a perspective view of security packaging according to the present invention.
Figure 2:
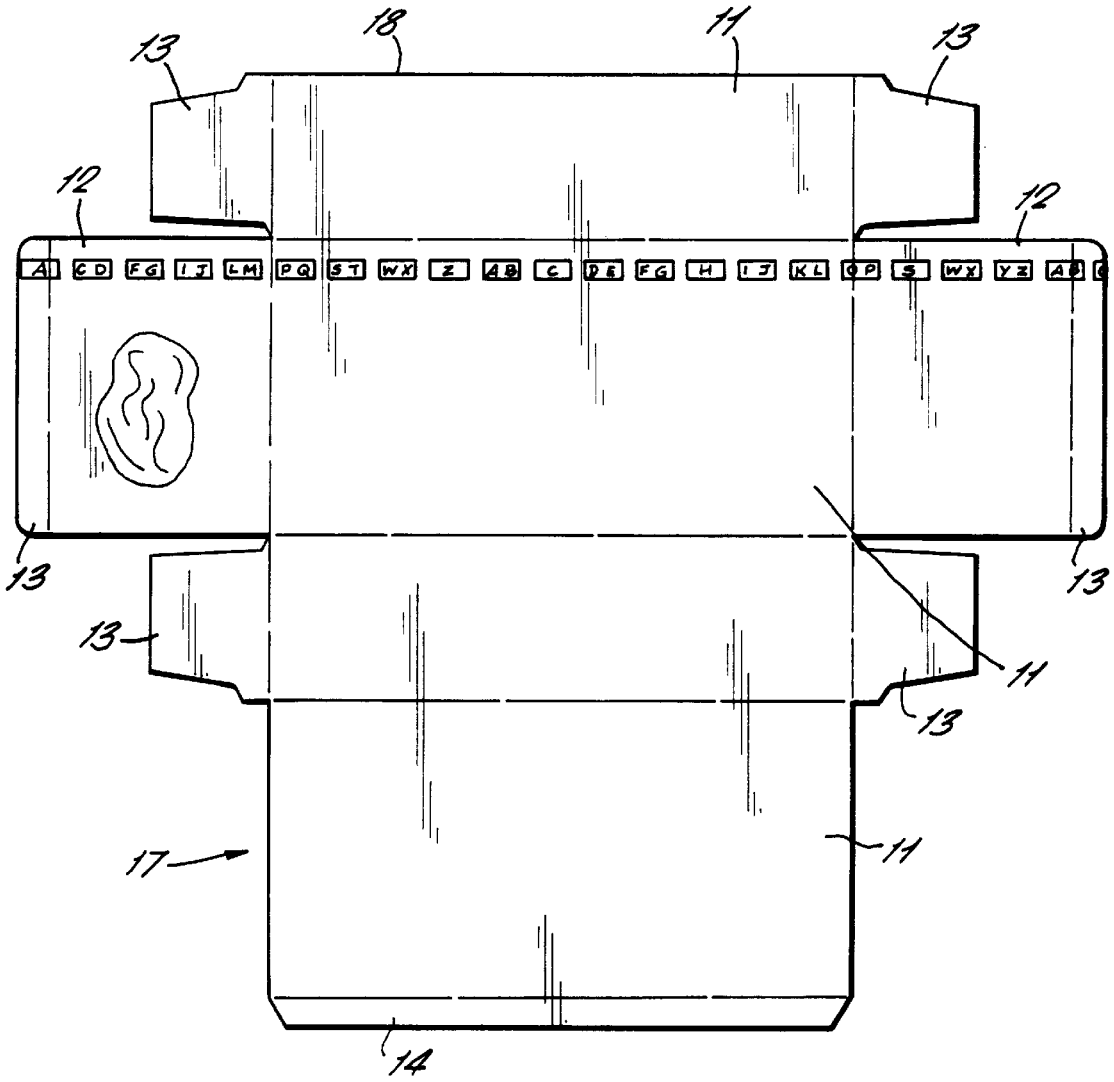
FIG. 2 is a blank used in the manufacture of the security packaging of FIG. 1.

Referring to FIGS. 1 and 2, there is shown a security package 10 in the form of a box-shaped carton. In the illustrated embodiment the package 10 has four side walls 11, two end walls 12 and additional flaps 13 are provided which are folded inside and help the package 10 to maintain its shape when assembled and closed. A glue flap 14 is provided along the edge of one of the side walls 11.

The security package 10 incorporates a security feature. One example of such a security feature is illustrated in FIG. 1 as a micro printed security thread 15 exposed at intervals in windows 16 in the surface of the package 10. The security feature forms an integral part of the material of the package 10 itself such that it cannot be removed from the package 10 without the destruction of the material of the package 10 or the security feature itself. Thus an attempted removal is tamper evident. The security feature also provides confirmation of the authenticity of the package 10 in that it either cannot be counterfeited or forged or it is so expensive and/or difficult to do so, that a would be counterfeiter would not attempt to do so.

The material for making the security package 10 can be made by a laminating process, laminating two or more substrates eg, a plurality of substrates which may include an identifier and a security feature in the adhesive. The first substrate is a backing substrate and is preferably made from a known folding box board, such as chipboard, having a preferred thickness in the range 100 to 1000$\mu$. It is possible, however, that the range could be as wide as 10 to 2000$\mu$ for some applications. The second substrate is a security paper having a preferred density in the range of 50–150 gsm. The security paper substrate can be made using known methods for making security paper for security documents, such as banknotes, passports, share certificates and the like on paper-making machines, such as cylinder mould or Fourdrinier machines. It may even be hand-made. A method such as that described in patent specification EP-A-0059056 can be used for making the security paper incorporating a security thread, where the security thread is exposed at regular intervals in windows in the surface of the paper as illustrated in FIG. 1. However the method selected is likely to be dependent on the security feature or features to be incorporated in the package 10. A range of fibre types can be used in the making of such paper, including synthetic or natural fibres or a mixture of both.

The security paper substrate may be independently made and subsequently laminated to the backing substrate again using known technology. This generally involves the use of an adhesive such as polyvinyl alcohol/starch. However the adhesive and the lamination process must be selected such that the lamination results in an integral sheet of material, the original substrates of which cannot be separated without damaging at least the security paper substrate.

It should be noted that although references have been made to the use of one security paper substrate and one backing substrate, other combinations can be used, such as two security paper substrates and one backing substrate, with the two security paper substrates applied one on either side of the backing substrate.

Once the laminated board has been prepared, usually in the form of a continuous web, it is cut into discrete sheets and printed by the package manufacturer. The printing process may include the printing of the package decoration, product information, a bar code and the outline of the carton blank 17 illustrated in FIG. 2. The carton blanks 17 are then stamped out from the sheets and each package 10 is assembled from a blank either by machine or hand. Adhesive is applied to the glue flap 14 which adheres to the inner surface of the free edge 18 of one of the side walls 11.

Although the preferred form of the invention involves laminating a security paper substrate containing a security feature to a backing substrate, if the security paper is made with a sufficiently high density and thickness such that it is really security board, then the backing substrate is not required and the security board itself can be used to form the blanks for the packages 10.

In another embodiment, the security paper substrate may be formed without any security features, and the security feature or features may be incorporated in the adhesive used in the laminating process.

The security paper substrate may also cover only a portion of the package 10 such that the material of the package is only partially laminated.

A wide range of different types of security features can be used in the present invention, some examples of which are listed below. A security package 10 according to the present invention may also incorporate a plurality of security features which may all be the same, or which may be different.

Known security features can be divided into those which provide overt security and those which provide covert security. The selection of security feature for any particular packaging will depend on the use of that packaging, what type of product it is used for, the type of market it is to be sold into etc.

Watermarks, windowed security threads and security inclusions are security features which provide overt security. Although watermarks are traditionally considered only to have use in applications where the security paper containing the watermark can be viewed in transmitted light, contrary to all technical prejudices it has been found that when paper containing a watermark is applied to a background of a darker or different colour to that of the security paper there is an unexpected and surprising effect in that the watermark is visible in a modified form in reflected light. Such watermarks can also be detected by touch as there is a surprising increase in the perceived variations in the surface of the security paper in the area of the watermark. This effect has been incorporated into watermarked labels as described in our co-pending application GB 9523015.7. Developed from this we have found that the laminating of security paper containing a watermark to a backing substrate results in a security feature comprising a watermark 20 which is visible in reflected light and has a tactile effect. With regard to the use of such a watermark 20 in the present invention, the effect of this can be further enhanced by using a coloured base substrate.

A wide range of different types of security threads can be used in the windowed thread version of the security package 10. These include coloured threads, metallised threads, de-metallised threads, holographic threads, de-metallised holographic threads, fluorescent threads, thermochromic threads, micro printed threads and other types of optically variable threads. When viewed in the windows, the purchasing customer can verify the authenticity of the product by what is seen.

Other overt security features which may be included in the security paper include fibres, planchettes, iridescent features and coatings.

Covert security features can also be provided by a number of known means. These include security fibres, embedded security threads, planchettes and furnishes which are only visible when the package 10 is subjected to fluorescent or infrared light, magnetic features, radio frequency encoded threads and circuits, taggants which may be biological, inorganic or coded inclusions and chemical sensitisation. Covert security features can also include embedded metallic or de-metallised threads which may be machine readable and may also provide a tactile effect.

All of these features can be used to authenticate the package 10 without having to destroy or damage the package 10 and without damaging or causing a permanent change to the security feature, so that it can be used repeatedly for its authentication purpose. It should also be noted that normal opening of the package does not destroy or permanently change the security feature.

The location of such a security feature or features may again depend on the feature selected, the ultimate use of the package 10, its final appearance and the manufacturing process. As shown in FIG. 1, a security thread 15 may be inserted to run lengthways along one of the side walls 11. Alternatively security feature could be applied to the glue flap 14 such that it is hidden once the package 10 is assembled. A machine would then be required to read the hidden feature. Discrete features such as the watermark 20 may be applied to a side wall or, as shown in FIG. 1, to an end wall, or it may repeat continuously along a length or across a width of the package 10. Indeed the locations of the security features may be either inside or outside the box or sandwiched between two sections, on the lid, the sides, the ends or an internal flap.

A further development of the present invention is to provide each security package 10, or batch of security packages, with a unique readable, verifiable or recognisable identifier by means of the security feature. The object is that although the packages 10 may be mass produced, each one or a particular batch would be unique and thus each package 10 or batch thereof could be tracked and identified. Thus if a consignment of goods was stolen from one country, when it appeared in another country, its origin could be located and this would help to track down the thieves.

Figure 3:
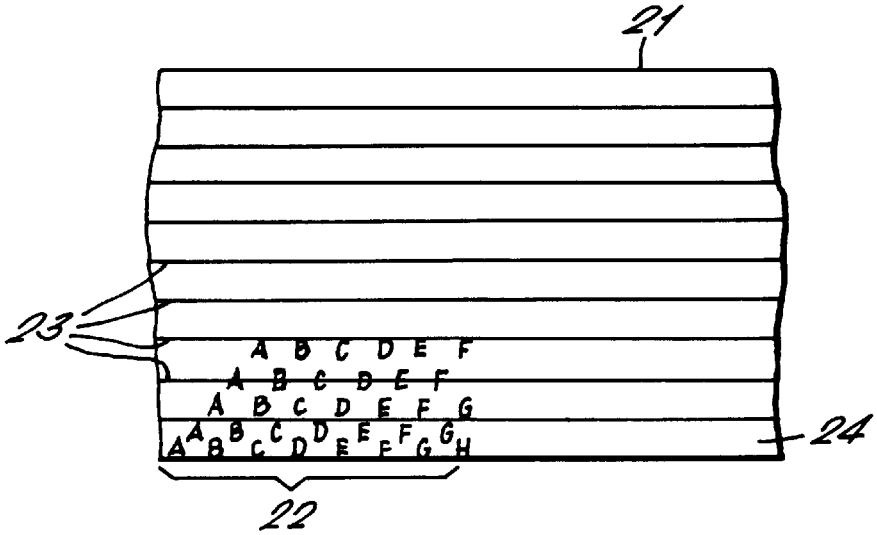
FIG. 3 is an enlarged view of the section of a micro printed film for use in the manufacturing of a security thread for the security packaging of FIG. 1.

One method of generating the unique identifiers is to use a windowed security thread 15. The thread is made by taking a web 21 of thread material (see FIG. 3) and micro printing a code 22 comprising, say, a series of offset streams of letters. The web 21 is then slit along the lines 23 to create the security threads 24 such that the micro printed code 22 on each resulting thread 24 is out of register.

Thus although the letters themselves are in exact register the security paper manufacturer has no control over where and at what point the thread 24 is fed into the paper making machine or where the windows 16 will occur relative to the code on the thread 24. Furthermore the paper making process itself introduces a further element of randomness in that the size and shape of the bridges 25 between the windows 16 and the windows 16 themselves are not exactly the same. Thus what appears in each window is random.

The randomness can be increased by applying an image, such as a holographic image, to the web 21 before it is micro printed or by designing the windows to be out of register with the image repeat.

This type of random encoding can be used on demetallised or holographic thread. As each package 10 or batch of packages 10 is produced with such a random encoding, the unique identifier for each package 10 can be recorded. One way of doing this would be to provide a platten or stencil which has a window revealing a specific area of the security feature and what can be seen in that area provides the unique identifier.

Other ways of creating unique identifiers include the random magnetic coding of threads, mapping of metallic fibres, bar coding and 2 dimensional bar coding of security threads, radio frequency encoded threads and circuits and other types of features which allow some form of electrical, magnetic or visible variation.

The security feature may be encoded either before its incorporation in the package 10 or after, the latter embodiment providing a programmable package.

We claim:

1. A blank for a counterfeit resistant security package made from a substantially rigid material incorporating at least one authenticating security feature, wherein the security feature comprises a physical inclusion which is at least partially embedded within the material during manufacture of the material to form a integral part of the material of the blank, such that it cannot be separated from the material without the disruption of the material or be at least one security feature which security feature is repeatedly verifiable without causing damage to the material, or causing damage or a permanent change to the security feature itself.

2. A blank for a counterfeit resistant security package as claimed in claim 1 in which the at least one security feature is visible to the eye.

3. A blank for a counterfeit resistant security package as claimed in claim 1 in which the at least one security feature is detectable by touch.

4. A blank for a counterfeit resistant security package as claimed in claim 1 in which the at least one security feature is machine-readable.

5. A blank for a counterfeit resistant security package as claimed in claim 1 in which the at least one security feature becomes visible when subjected to a change in temperature.

6. A blank for a counterfeit resistant security package as claimed in claim 1 in which the at least one security feature becomes visible when subjected to infrared or fluorescent light.

7. A blank for a counterfeit resistant security package as claimed in claim 1 in which the at least one security feature is encoded.

8. A blank for a counterfeit resistant security package as claimed in claim 1 in which the at least one security feature is encodable.

9. A blank for a counterfeit resistant security package as claimed in claim 1 in which the material of the blank comprises a plurality of substrates laminated together to form an integral sheet.

10. A blank for a counterfeit resistant security package as claimed in claim 9 in which one of the substrates comprises security paper incorporating the at least one security feature.

11. A blank for a counterfeit resistant security package as claimed in claim 9 in which one of the substrates comprises a backing layer of folding box board.

12. A blank for a counterfeit resistant security package as claimed in claim 9 in which the substrates are laminated together by means of an adhesive.

13. A blank for a counterfeit resistant security package as claimed in claim 12 in which the at least one security feature is incorporated in the adhesive.

14. A blank for a counterfeit resistant security package as claimed in claim 12 in which the adhesive is coloured.

15. A blank for a counterfeit resistant security package as claimed in claim 9 in which at least one of the substrates is coloured.

16. A blank for a counterfeit resistant security package as claimed in claim 11 in which the backing layer substrate is of a darker colour than the security paper substrate.

17. A blank for a counterfeit resistant security package as claimed in claim 1 in which the material of the blank is formed from a single substrate incorporating the at least one security feature.

18. A blank for a counterfeit resistant security package as claimed in claim 1 in which the at least one security feature provides a unique identifier.

19. A blank for a counterfeit resistant security package as claimed in claim 18 in which the unique identifier is randomly encoded.

20. A blank for a counterfeit resistant security package as claimed in claim 18 in which the unique identifier is generated before the security feature is incorporated into the blank material.

21. A blank for a counterfeit resistant security package as claimed in claim 18 in which the at least one security feature is provided with the unique identifier after its incorporation into the blank material.

22. A blank for a counterfeit resistant security package as claimed in claim 1 comprising a plurality of security features some or all of which may be the same or different.

23. A blank for a counterfeit resistant security package as claimed in claim 1 in which the at least one security feature is continuous or repeated from a first edge to an opposing edge of the blank.

24. A counterfeit resistant security package comprising a container made from a blank as claimed in claim 1.

25. A blank for a counterfeit resistant security package said blank comprising a substantially rigid material incorporating at least one authenticating and tamper evident security feature which is repeatedly verifiable for authentication purposes without causing damage to the material, or causing damage or a permanent change to the security feature itself, and which said at least one security feature comprises a security thread forming an integral part of the material of the blank, such that it cannot be separated from the material without the destruction of at least one of the material and the at least one security feature.

26. A method of making a counterfeit resistant security package comprising the steps of forming a sheet of substantially rigid material, cutting at least one blank from the sheet of material and assembling a security package from said blank, said package having means for opening and closing the package, wherein during the material forming process at least one authenticating security feature is at least partially embedded within the material, said security feature comprising a physical inclusion which is repeatedly verifiable without causing damage to the material, or causing damage or a permanent change to the security feature itself, so that said at least one security feature thereby forms an integral part of the material, such that it cannot be separated from the material without the disruption of the material, or the at least one security feature, wherein opening or closing of the security package by the opening and closing means does not damage or cause a permanent change to the security feature.

27. A method as claimed in claim 26 further comprising the step of laminating a plurality of substrates together to form an integral sheet of said material.

28. A method as claimed in claim 27 further comprising the step of making security paper containing the at least one security feature to form a first substrate.

29. A method as claimed in claim 27 further comprising the step of making a second substrate from folding box board.

30. A method as claimed in claim 29 further comprising the step of making continuous webs of the first and second substrates and continuously laminating the substrates together.

31. A method as claimed in claim 27 in which the substrates are laminated together by means of an adhesive.

32. A method as claimed in claim 31 in which the at least one security feature is incorporated in the adhesive before the laminating step.

33. A method as claimed in claim 26 in which a dye or other colorant is added to the adhesive before the laminating step.

34. A method as claimed in claim 26 in which the at least one security feature is continuous or repeated from a first edge to an opposing edge of the blank.

35. A method as claimed in claim 26 in which the at least one security feature is encoded with a unique identifier before its incorporation into the material.

36. A method as claimed in claim 26 in which the security feature is encoded with a unique identifier after its incorporation into the material.

37. A method as claimed in claim 35 in which the unique identifier is randomly encoded.

38. A method as claimed in claim 37 in which the unique identifier is generated by applying a plurality of offset strings of indicia to a web of security film, slitting the web to form a plurality of security threads out of register with the strings of indicia and incorporating one or more of said security threads into the material, such that the thread is exposed at intervals in windows in a surface of the material.

39. A method as claimed in claim 38 in which the strings of indicia are applied to a discrete or series of discrete security features.

40. A method of making a counterfeit resistant security package comprising the steps of forming a sheet of substantially rigid material, cutting at least one blank from the sheet of material and assembling a security package from said blank, said package having means for opening and closing the package, wherein during the material forming process at least one authenticating security feature is at least partially embedded within the material, said security feature comprising a security thread which is repeatedly verifiable without causing damage to the material, or causing damage or a permanent change to the security feature itself so that the at least one security feature thereby forms an integral part of the material, such that it cannot be separated from the material without the disruption of at least one of the material or the at least one security feature, wherein opening or closing of the security package by the opening and closing means does not damage or cause a permanent change to the security feature.

* * * * *